United States Patent [19]

Umezawa et al.

[11] 4,305,651

[45] Dec. 15, 1981

[54] SYSTEM FOR ADJUSTING OUTPUT CURRENT OF DISCHARGE ELECTRODE FOR ELECTROPHOTOGRAPHIC COPYING MACHINES

[75] Inventors: Tadashi Umezawa, Kunitachi; Seiichi Yagi, Shiroyama; Katsuhiro Syukuri, Hino, all of Japan

[73] Assignee: Konishiroku Photo Industry Co., Ltd., Tokyo, Japan

[21] Appl. No.: 123,836

[22] Filed: Feb. 22, 1980

[30] Foreign Application Priority Data

Feb. 25, 1979 [JP] Japan ..... 54-21252

[51] Int. Cl.[3] ..... G03G 15/02

[52] U.S. Cl. ..... 355/3 CH; 323/354; 361/229

[58] Field of Search ..... 323/36, 80, 297, 354; 355/3 CH, 14 CH; 361/225, 229

[56] References Cited

U.S. PATENT DOCUMENTS

| | | | |
|---|---|---|---|
| 3,392,626 | 7/1968 | Miller et al. | 323/36 X |
| 3,912,989 | 10/1975 | Watanabe et al. | 361/229 |
| 4,003,650 | 1/1977 | Courtney et al. | 355/14 CH |
| 4,136,942 | 1/1979 | Nakahata et al. | 355/14 CH |

*Primary Examiner*—A. D. Pellinen

*Attorney, Agent, or Firm*—James E. Nilles

[57] ABSTRACT

A system for adjusting the output current of a discharge electrode for electrophotographic copying machines comprising the step of adjusting the output current of the discharge electrode in the electrophotographic copying machine by selecting a selector switch which corresponds to a class of photosensitive members, such that the discharge electrode produces an output current which is suited for the photosensitive members of the class.

3 Claims, 3 Drawing Figures

SYSTEM FOR ADJUSTING OUTPUT CURRENT OF DISCHARGE ELECTRODE FOR ELECTROPHOTOGRAPHIC COPYING MACHINES

BACKGROUND OF THE INVENTION

The present invention relates to an improvement in a system for adjusting an output current of a discharge electrode for electrophotographic copying machines (hereinafter simply referred to as copying machines).

In the conventional copying machines, the output of a discharge electrode is adjusted to suit for the charging characteristics of a photosensitive member after each replacement of the photosensitive member. Particularly, when the photosensitive member contains a sensitizing agent composed of a selenium compound, the output current must be adjusted after each replacement. When the charging characteristics of the photosensitive member have not been known, the output of the discharge electrode must be adjusted while checking the charging characteristics, requiring a specially designed device. Therefore, it is difficult to quickly perform the adjustment in a site where the copying machine is installed. Or even when the charging characteristics of the photosensitive member have been known, the adjustment must be effected while observing the output current by an ammeter, requiring very clumsy operation and a lot of time.

FIG. 1 is a diagram of a power supply circuit for a discharge electrode incorporating an adjusting circuit, which is used for a conventional copying machine. According to this power supply circuit, constant current characteristics and constant voltage characteristics are obtained by feeding back an output current and an output voltage to an oscillation circuit, relying upon a high-voltage power supply of an inverter type. Namely, with the conventional copying machines, an ammeter is inserted between an output terminal P and a discharge electrode or a voltmeter is inserted between the output terminal P and the ground, and a variable resistor VR inserted in a feedback path to the oscillation circuit is manipulated to vary the output current or the output voltage while viewing the ammeter or the voltmeter to find an optimum output value.

SUMMARY OF THE INVENTION

The inventors of the present invention have forwarded research in an attempt to easily carry out the adjustment when the photosensitive member is to be replaced, and have found the fact that if the photosensitive members are suitably divided into several classes depending upon their charging characteristics, the power supply can be so adjusted that the discharge electrode gives an optimum output current for a representative charging characteristic within a range of each class, making it possible to obtain satisfactory copying results even though the charging characteristics of the photosensitive members may slightly differ within the range of the same class, and have thus accomplished the present invention.

In effect, the object of the present invention is to provide a system for adjusting an output current of a discharge electrode for copying machines comprising classifying photosensitive members depending upon their charging characteristics, selecting a circuit for adjusting the output current of the discharge electrode in the copying machine by a selector switch depending upon a class of photosensitive members, and selecting a selector switch which corresponds to a new class when the photosensitive members are to be replaced by a different class of photosensitive members, such that the discharge electrode produces an output current which is suited for the photosensitive members of the new class.

DETAILED DESCRIPTION OF THE PREFERRED EMBODIMENT

Figure 1:
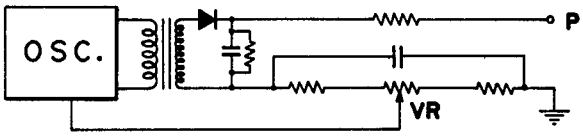
FIG. 1 PRIOR ART
FIG. 1 is a diagram of a power supply circuit for a discharge electrode incorporating an adjusting circuit, which is employed for a conventional copying machine.
Figure 2:
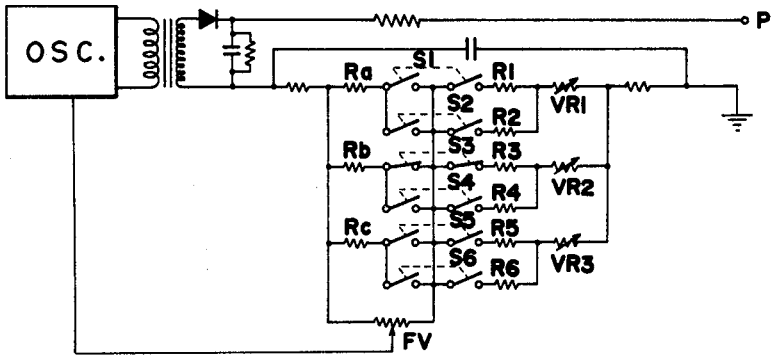
FIG. 2 is a diagram of a power supply circuit for a discharge electrode used for a copying machine of the present invention.

FIG. 2 illustrates an example of a power supply circuit which includes a circuit for adjusting the output current of a discharge electrode, and which corresponds to the case in which the charging characteristics of the photosensitive members are divided into six classes.

Symbols $S_1$ to $S_6$ denote selector switches which consist of a double-circuit rotary switch having 6 contacts or push-button switches of the charge-over type. When the selector switch $S_1$ is selected to correspond to the charging characteristics of the photosensitive members of a first class, a circuit $S_1$ including resistors $R_1$, Ra is closed permitting a constant output current $i_1$ to flow into a discharge electrode which is connected across the output terminal P and the ground. When the selector switch $S_2$ is selected to correspond to the charging characteristics of the photosensitive members of a second class, a circuit $S_2$ including resistors $R_2$, Ra is closed and the circuit $S_1$ is opened, so that a constant output current $i_2$ is allowed to flow to the discharge electrode. Similarly, a constant output current $i_3$ flows when the selector switch $S_3$ is selected, a constant output current $i_4$ flows when the selector switch $S_4$ is selected, a constant output current $i_5$ flows when the selector switch $S_5$ is selected, and a constant output current $i_6$ flows when the selector switch $S_6$ is selected.

Symbols $VR_1$ to $VR_3$ denote variable resistors for finely adjusting the output current of the discharge electrode to suit for the representative charging characteristic of each class, and symbol FV denotes a variable resistor for effecting fine adjustment to cope with the shape of the discharge electrode or mounting errors. These variable resistors will be adjusted during or after inspection of the copying machine in the factory, and need not be adjusted by the users in replacing the photosensitive members.

Figure 3:
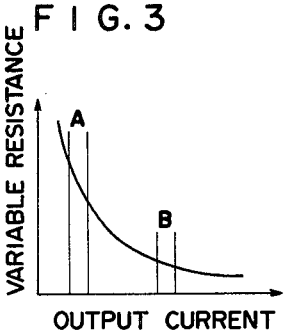
FIG. 3 is a graph showing a relation between the resistance of a variable resistor inserted in a feedback path to an oscillation circuit and the output current.

A relation between the resistance of the variable resistor in a feedback path to the oscillation circuit and the output current, varies as shown in FIG. 3. Therefore, with the copying machine being adjusted by the variable resistor FV to suit for the photosensitive members having high charging characteristics which require a reduced output current as denoted by A, if the selector switch is changed to process the photosensitive members having low charging characteristics which require an increased output current as denoted by B, the adjustment may often become excessive or, conversely, insufficient. To preclude such an inconvenience according to the present invention, resistors Ra, Rb and Rc (Ra>Rb>Rc in this embodiment) are commonly inserted in the circuits which correspond to the charging characteristics of the neighbouring two classes and are connected to the variable resistor FV in parallel with the resistors $R_1$ to $R_6$ of each of the circuits which correspond to each of the classes. Accordingly, the output current can be adjusted to suit well for the charging characteristics of each of the classes. Each of the variable resistors $VR_1$ to $VR_3$ is also commonly connected to two circuits corresponding to the charging characteristics of the neighbouring two classes as shown in FIG. 2, in order to assure sufficient accuracy for each of the classes.

With the copying machine of the present invention which has been adjusted as mentioned above, when the photosensitive members are replaced by the photosensitive members having different charging characteristics, the selector switch needs be simply selected to suit for the class of charging characteristics. Then, the discharge electrode is so set as to discharge an output current which is suited for sensitizing the photosensitive members, enabling the copying operation to be stably carried out.

The present invention is by no means limited to the aforementioned embodiment only, but can also be applied to the photosensitive members which use sensitizing agents other than selenium compounds, and to the sheet-like photosensitive members in addition to the drum-like photosensitive members. Furthermore, the photosensitive members may be more finely classified or coarsely classified depending upon a variance in the charging characteristics. Moreover, an adjusting circuit employing a variable resistor which is not directly related to the replacement of the photosensitive members may be modified or eliminated.

What is claimed is:

1. An electrophotographic copying machine characterized by comprising a high-voltage power supply, a discharge electrode connected to an output terminal of the high-voltage power supply, a photosensitive member classified previously to one rank of a plurality of ranks according to the charging characteristics thereof, and a circuit for adjusting the output current of the discharge electrode according to the charging characteristics of the photosensitive member to be used, provided between the high-voltage power supply and the output terminal thereof, the circuit for adjusting the output current of the discharge electrode having a group of selector switches $S_1$–$S_6$ connected in parallel with one another and a group of resistors each connected in series with each switch.

2. An electrophotographic copying machine according to claim 1, wherein a finely adjustable variable resistor is inserted in the circuit for adjusting the output current of the discharge electrode relative to the shape of the discharge electrode or relative to a mounting error of the discharge electrode, so that a constant output current flows to the discharge electrode to suit well for the photosensitive members.

3. An electrophotographic copying machine according to claim 2, wherein the circuit for adjusting the output current of the discharge electrode possesses, in parallel therewith, resistors which include a variable resistor that is selectively connected via the selector switch to a feedback path which is connected to an oscillation circuit of the high voltage power supply of the inverter type, so that the output current flowing into the discharge electrode is adjusted to be suited for each of the classified photosensitive members.

* * * * *